US006381991B2

(12) United States Patent
Ando'

(10) Patent No.: US 6,381,991 B2
(45) Date of Patent: May 7, 2002

(54) METHOD AND APPARATUS FOR MANUFACTURING TUBULAR ITEMS, PARTICULARLY HOSIERY ITEMS, CLOSED AT AN AXIAL END

(75) Inventor: Jan Ando', Scandicci (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 09/777,945

(22) Filed: Feb. 6, 2001

(30) Foreign Application Priority Data

Feb. 28, 2000 (IT) ..... MI00A0373

(51) Int. Cl.[7] ..... D04B 9/56
(52) U.S. Cl. ..... 66/58; 66/148
(58) Field of Search ..... 66/13, 17, 18, 66/43, 58, 147, 148, 149 S, 149 R, 150

(56) References Cited

U.S. PATENT DOCUMENTS 4,122,690 A * 10/1978 Moreni ..... 66/14
5,231,856 A * 8/1993 Lonati et al. ..... 66/147
5,570,591 A * 11/1996 Frullini et al. ..... 66/58
5,924,309 A * 7/1999 Conti ..... 66/148
6,105,399 A * 8/2000 Frullini et al. ..... 66/148
6,158,252 A * 12/2000 Conti ..... 66/148
6,164,091 A * 12/2000 Frullini et al. ..... 66/148

FOREIGN PATENT DOCUMENTS

DE 560614 * 9/1932 ..... 66/148

* cited by examiner

*Primary Examiner*—Danny Worrell
(74) *Attorney, Agent, or Firm*—Welsh & Katz, Ltd.

(57) ABSTRACT

A method and an apparatus for manufacturing tubular items, particularly hosiery items, closed at an axial end. The method consists in forming the tubular item on a circular knitting machine by way of the needles of the needle cylinder, starting from the opposite axial end of the item with respect to the axial end to be closed and retaining on the needles of the needle cylinder the last formed row of knitting. The loops of the last row of knitting are then transferred individually from the needles of the needle cylinder to an auxiliary element provided with elements for individually supporting the loops. The supporting elements of at least one half-row of the last row are suitable to receive two loops and to form knitting. The item is reversed before or after transferring it and the loops of one half-row are transferred from the corresponding supporting elements to the supporting elements engaged with the loops of the other half-row. The supporting elements that support the two half-rows form at least one additional row of knitting, closing the axial end of the item, which is then unloaded from the supporting elements.

10 Claims, 7 Drawing Sheets

1
2
5
12a
30
40
40a
30a
12b
5b
5c
6
7
7a
5a
30b
27a
26
27
25a
25c
25
25b
24
3
28
3a 1
2
2a
12a
5
7
30a
27
25
28
30
3a
12b
5b
5c
6
7a
4
5a
30b
27a
26
25a
25c
24
3

METHOD AND APPARATUS FOR MANUFACTURING TUBULAR ITEMS, PARTICULARLY HOSIERY ITEMS, CLOSED AT AN AXIAL END

BACKGROUND OF THE INVENTION

The present invention relates to a method and an apparatus for manufacturing tubular items, particularly hosiery items, closed at an axial end.

It is known that hosiery items are generally manufactured on circular hosiery knitting machines and that in the conventional manufacturing method they are unloaded from the machine while their toe is still open and must be subjected to subsequent sewing or looping in order to form the finished product.

Since the sewing or looping operation requires a manual intervention of an operator to load the hosiery item on the looping or sewing machine, this operation has a significant effect on the overall manufacturing costs of hosiery items.

For this reason, methods and devices have been devised in recent years which are adapted to obtain hosiery items having a closed toe directly on the machine that manufactures them or are adapted to mechanize the transfer of the hosiery items from the machine that produces them to the looping or sewing machine in order to fully eliminate, or at least substantially reduce, manual interventions for performing this operation.

In some of these methods, for example in the method disclosed in Italian Patent No. 1,277,396 in the name of the same Assignee, the hosiery item is started from the opposite end with respect to the toe, i.e., from the top of the leg, and is completed at the toe, retaining the last row of knitting on the needles of the machine. Such last row is then transferred, loop by loop, from the needles of the circular machine to the hooks supported by an annular element which is arranged around the upper end of the needle cylinder. The annular element is divided into two halves which can overlap one another so as to overlap the loops of one half-row, carried by the hooks arranged in one half of the annular element, on the loops of the other halfrow, which are supported by the hooks of the other half of the annular element. In a subsequent step, the pairs of loops thus arranged side by side are sewn in order to join them thereby closing the toe of the hosiery item, which is then unloaded from the annular element.

The closure of the toe, performed with methods and devices of this kind, has the drawback that it is not fully satisfactory from an aesthetic point of view.

The joining of mutually adjacent pairs of loops by sewing in fact does not achieve a tight coupling of the loops that can be compared with the one obtainable by conventional sewing or looping.

SUMMARY OF THE INVENTION

The aim of the present invention is to solve the above problem by devising a method and an apparatus for manufacturing tubular items, particularly hosiery items, which are closed at an axial end and in which the closure of said axial end is fully satisfactory.

Within this aim, an object of the invention is to provide a method which allows to obtain a closure of an axial end of a tubular item which can be compared with the closure that can be obtained by means of conventional sewing or looping.

Another object of the invention is to provide a method which allows to manufacture tubular items, particularly hosiery items, which are closed at an axial end in a fully automated manner and therefore without requiring the manual intervention of an operator.

Another object of the invention is to provide an apparatus which allows to obtain tubular items, particularly hosiery items, which are closed at an axial end and can be installed easily on currently commercially available circular hosiery knitting machines.

This aim and these and other objects which will become better apparent hereinafter are achieved by a method for manufacturing tubular items, particularly hosiery items, closed at an axial end, comprising a step for forming the tubular item on a circular hosiery knitting machine by way of the needles of the needle cylinder, starting from the opposite axial end of the item with respect to the axial end to be closed and retaining on the needles of the needle cylinder the last formed row of knitting, characterized in that it comprises the following additional steps:

individually transferring the loops of the last formed row of knitting from the needles of the needle cylinder to an auxiliary element provided with supporting means for individually supporting the loops, the supporting means of at least one half-row of said last row being adapted to receive two loops and to form knitting;

reversing the item;

transferring the loops of one half-row from the corresponding supporting means to the supporting means engaged with the loops of the other half-row;

forming at least one additional row of knitting, closing the axial end of the item, with the supporting means that carry said half-rows;

unloading the item from said supporting means.

The method according to the invention is preferably performed by way of an apparatus for manufacturing tubular items, particular hosiery items, closed at an axial end, characterized in that it comprises a circular auxiliary element which can coaxially face the end of the needle cylinder that corresponds to the needle work area of a circular hosiery knitting machine, said auxiliary element being provided with supporting means which are adapted to individually receive the loops of a row of knitting formed and retained by the needles of the needle cylinder, the supporting elements of at least one half-row of said row of knitting being actuatable in order to form knitting.

BRIEF DESCRIPTION OF THE DRAWINGS

Further characteristics and advantages of the invention will become better apparent from the description of a preferred but not exclusive embodiment of the method according to the invention and of the apparatus for performing it, illustrated only by way of non-limitative example in the accompanying drawings, wherein.

DESCRIPTION OF THE PREFERRED EMBODIMENTS

Figure 2:
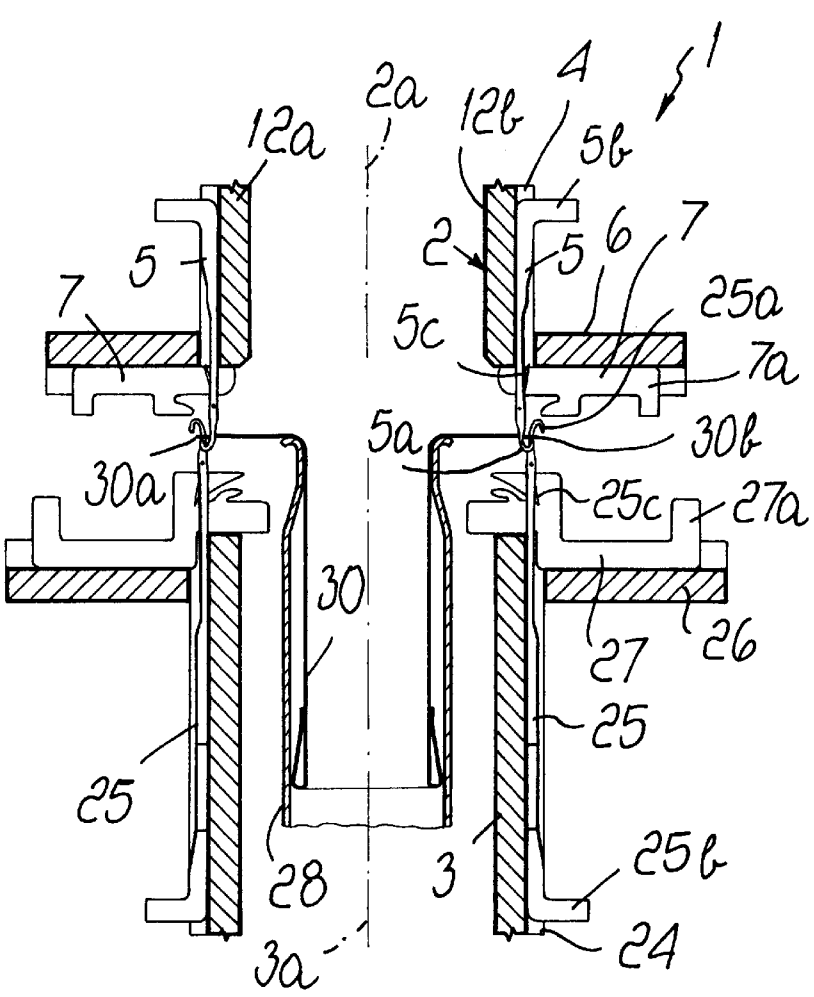
FIGS. 1 to 13 show schematically the sequence of operating steps of the method according to the invention, performed on a circular hosiery knitting machine and with an apparatus according to the invention, both of which are shown schematically in axial sectional views.

With reference to the figures, the method according to the invention is preferably performed by means of an apparatus, generally designated by the reference numeral 1, comprising a circular auxiliary element which can coaxially face the end of the needle cylinder 3 that corresponds to the needle work area of a circular hosiery knitting machine. Said auxiliary element is provided with supporting means which are suitable to individually receive the loops of a row of knitting formed and retained by the needles 25 of the needle cylinder 3, and the supporting elements of at least one half-row of said row of knitting can be actuated in order to form knitting.

The auxiliary element is preferably constituted by an auxiliary needle cylinder 2 which can be arranged above and coaxially with respect to the needle cylinder 3 of a circular hosiery knitting machine.

The auxiliary needle cylinder 2 has, like the needle cylinders of hosiery knitting machines, a plurality of axial slots 4 on its side wall; each one of said slots accommodates a needle 5 whose tip 5*a* is directed downward.

In practice, the auxiliary needle cylinder 2 corresponds to an inverted needle cylinder whose structure is simplified with respect to the needle cylinder of conventional hosiery knitting machines. The auxiliary needle cylinder 2 is further provided, at its lower end, with a sinker ring 6 accommodating in a per se known manner a plurality of sinkers 7 which can be actuated in order to cooperate with the needles 5 in forming knitting.

The sinkers 7 can be actuated with a translatory motion toward or away from the axis 2*a* of the auxiliary needle cylinder 2 by way of appropriately provided cams, not shown for the sake of simplicity, which face in a downward region the sinker ring 6 and form paths for a heel 7*a* of the sinkers.

The needles 5 constitute the supporting means for supporting the loops of knitting and are each provided with at least one heel 5*b* which protrudes radially from the slots 4 of the auxiliary needle cylinder 2 and can engage cams which are arranged around the side wall of the auxiliary needle cylinder 2 and define paths for the heels 5*b* of the needles 5.

The auxiliary needle cylinder 2 can be actuated with a rotary motion about its own axis 2*a* with respect to the cams that define the paths for the heels 5*b* of the needles 5 and with respect to the cams that define the paths for the heels 7*a* of the sinkers 7, so that the rotation of the auxiliary needle cylinder 2 about the axis 2*a* moves the needles 5 along the axial slots 4 of the auxiliary needle cylinder 2 in order to form knitting and for other operations described in detail hereinafter, and actuates the sinkers 7 towards or away from the axis 2*a* of the auxiliary needle cylinder 2 in order to cooperate with the needles 5 in the formation of knitting.

Differently from conventional needle cylinders, the auxiliary needle cylinder 2 is provided in two halves 12*a* and 12*b* which are coupled one another on a diametrical plane which passes through the axis 2*a* of the auxiliary needle cylinder 2.

A first half 12*a* of the auxiliary needle cylinder 2, together with the corresponding needle and sinker actuation cams, is pivoted to a supporting structure, not shown for the sake of simplicity, about an axis 13 which is parallel to a diametrical axis at right angles to the axis 2*a* of the auxiliary needle cylinder 2, so that it can be rotated on command about said axis 13 in order to move the needles 5 that belong to the first half 12*a* so that their tip 5*a* faces from below the tip 5*a* of the needles 5 supported by the second half 12*b* of the auxiliary needle cylinder 2.

The needle cylinder 3 is constituted by a conventional needle cylinder having, on its side wall, multiple axial slots 24, each whereof internally slidingly accommodates a needle 25 which can be actuated in a per se known manner in order to form knitting.

The needle cylinder 3 is further provided with a sinker ring 26 having a plurality of radial slots which accommodate, in a per se known manner, sinkers 27 which can be actuated in order to cooperate with the needles 25 in forming knitting.

The needle cylinder 3 can be actuated with a rotary motion about its own axis 3*a* in a per se known manner with respect to cams which face the side wall of the needle cylinder 3 and define paths which can be engaged by the heels 25*b* of the needles 25 and with respect to cams which face the sinker ring 26 in an upward region, are not shown for the sake of simplicity and define paths for the heels 27*a* of the sinkers 27, so as to achieve the actuation, in a per se known manner, of the needles 25 and of the sinkers 27 in order to form knitting.

A substantially cylindrical suction duct 28 is accommodated inside the needle cylinder 3 and coaxially thereto and can be connected to suction means in order to tension the item 30 during its manufacture.

The apparatus for performing the method according to the invention also comprises means for reversing the item 30.

Said reversing means comprise a first substantially cylindrical suction duct 40 being arranged internally and coaxially with respect to the auxiliary needle cylinder 2 and has an inlet 40*a* which is directed downward.

The means for reversing the item 30 also comprise a second substantially cylindrical suction duct 41 which has a smaller diameter than the first suction duct 40. Said second suction duct 41 is arranged internally and coaxially with respect to the first suction duct 40. The inlet of the second suction duct 41 also is directed downward, preferably at a higher level than the inlet of the first suction duct 40.

An interspace 42 is defined between the first suction duct 40 and the second suction duct 41 and is capable of receiving the item 30. During the operation of the apparatus it is possible to connect the interspace 42 or the second suction duct 41 to suction means in order to reverse the item 30, as will become apparent hereinafter.

The operation of the apparatus 1 in the execution of the method according to the invention is as follows.

First of all, an item 30 is manufactured on a circular hosiery knitting machine starting from the opposite axial end of the item with respect to the axial end to be closed, and the last formed row of knitting, constituted by loops 30*a* and 30*b*, is retained on the needles 25 of the needle cylinder 3.

Figure 1:
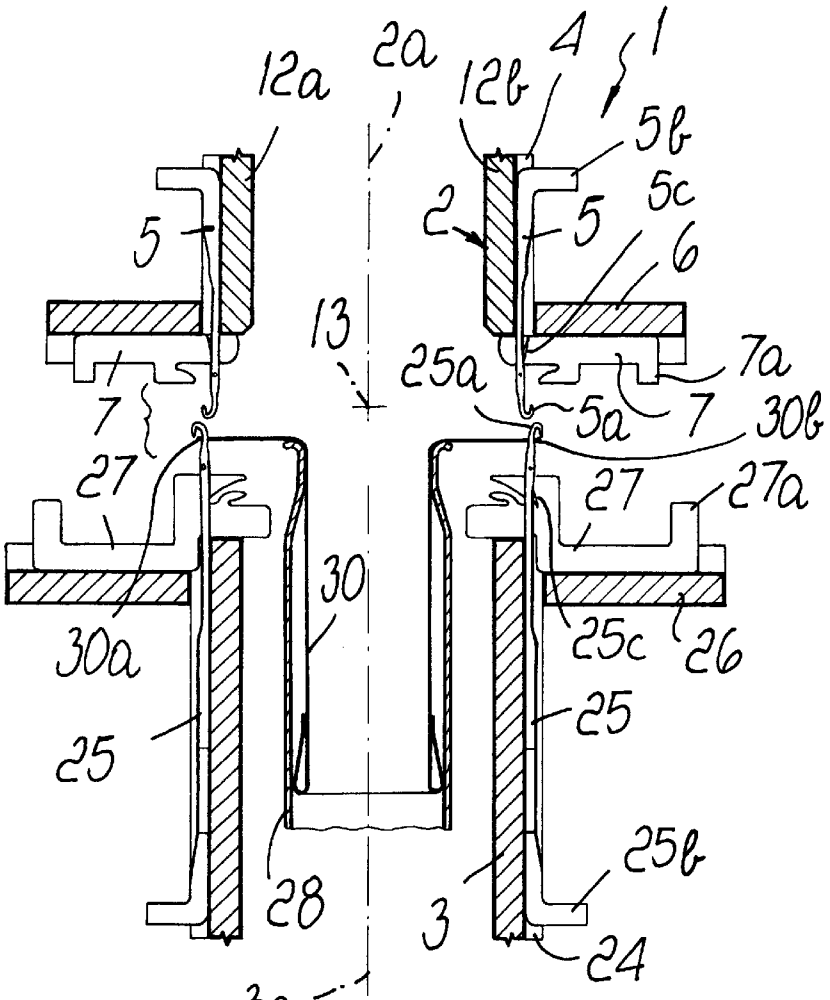

Then the auxiliary needle cylinder 2 is arranged above the needle cylinder 3 and coaxially thereto; in said auxiliary needle cylinder, the needles 5 are angularly spaced around the axis 2*a* so as to match the angular spacing of the needles 25 around the axis 3*a*. Substantially, for each needle 25 of the needle cylinder 3 there is a needle 5 in the auxiliary needle cylinder 2. Preferably, the needles 5 are arranged along a cylindrical surface whose diameter is smaller than the diameter of the cylindrical surface along which the needles 25 are arranged in the needle cylinder 3, as shown in FIG. 1.

In this step, the tip 25*a* of the needles 25 of the needle cylinder 3 is arranged above the sinkers 27, and the loops 30*a* and 30*b* of the last formed row of knitting are in the beak or tip of the needles 25. The item 30 is supported by the suction duct 28, so that the loops 30*a* and 30*b* of the last formed row of knitting are retained in the beaks of the needles 25 without descending along the stem of said needles, and said suction duct 28 is connected to suction means in order to keep the item 30 tensioned.

The needles 5 of the auxiliary needle cylinder 2 are then moved downward by way of the cams that actuate them so as to enter, with their tip 5*a*, the loops carried by the needles 25 of the needle cylinder 3, as shown in FIG. 2.

Figure 3:
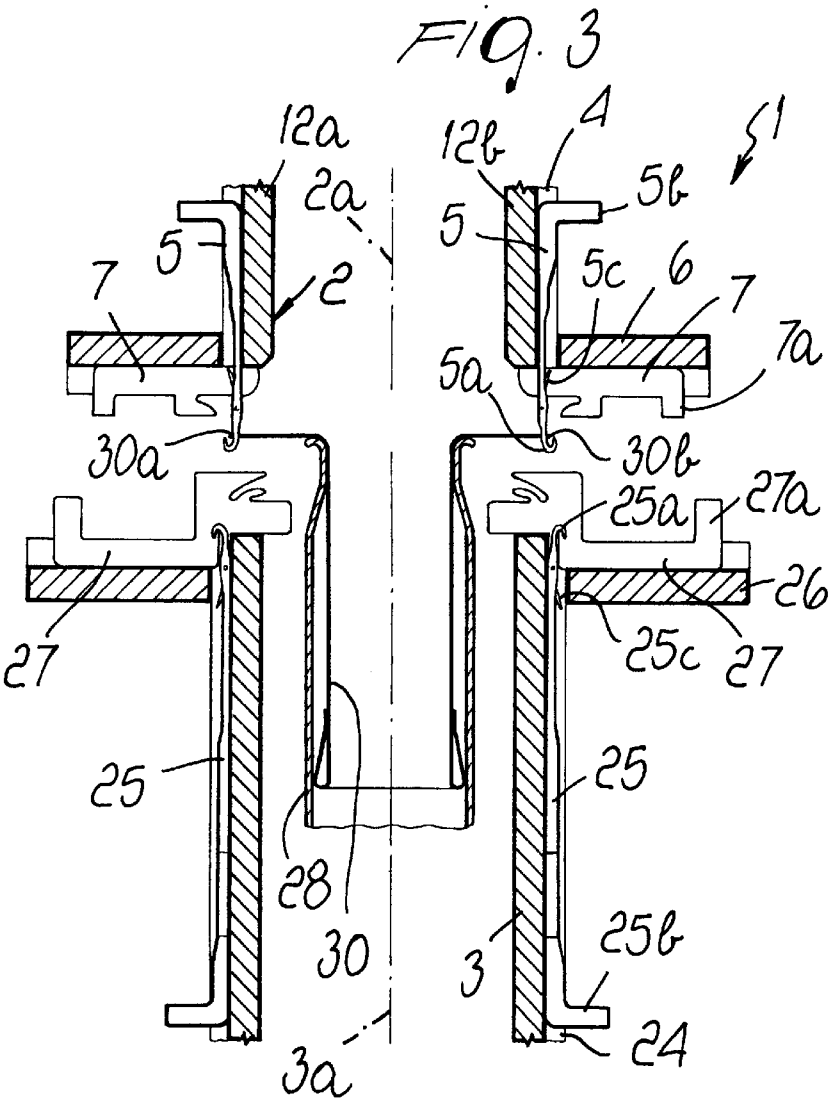

In a subsequent step, the needles 25 are raised so that their tongue 25*c* moves beyond the last formed loop of knitting 30*a* and 30*b* and are then lowered so as to achieve the closure of the tongue 25*c* on the part of said loop and thus abandon said loop 30*a* and 30*b*, which remains engaged on the tip 5*a* of the needles 5 of the auxiliary needle cylinder 2, as shown in FIG. 3.

Figure 4:
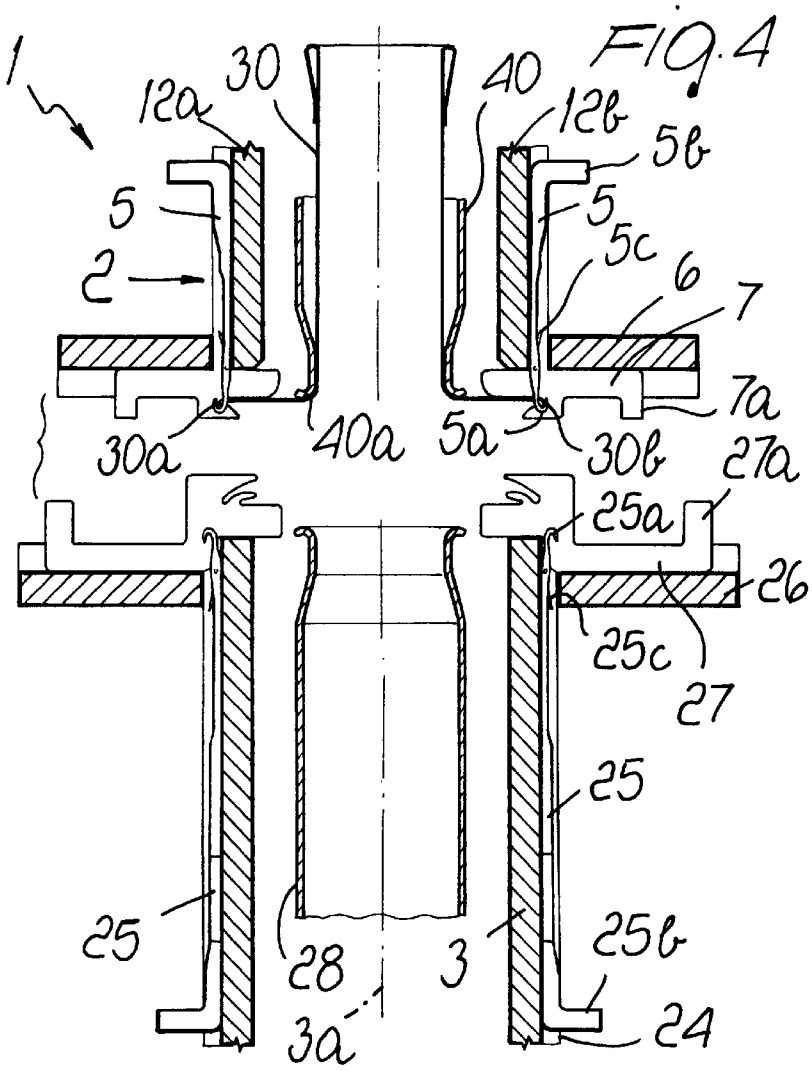

At this point the needles 5 are raised so that their tip 5*a* rises above the beak of the sinkers 7 and the first suction duct 40 is connected to suction means which draw into the first suction duct 40, and more specifically into the interspace 42, the item 30, which is thus subjected to a first reversing. In this condition, the item 30 is inside out, i.e., its normally outward side is directed toward the axis 2*a* of the auxiliary needle cylinder 2, as shown in FIG. 4.

It should be noted that the item 30 might be reversed, by suction inside the suction duct 40, even before it is transferred from the needles 25 to the needles 5.

Figure 5:
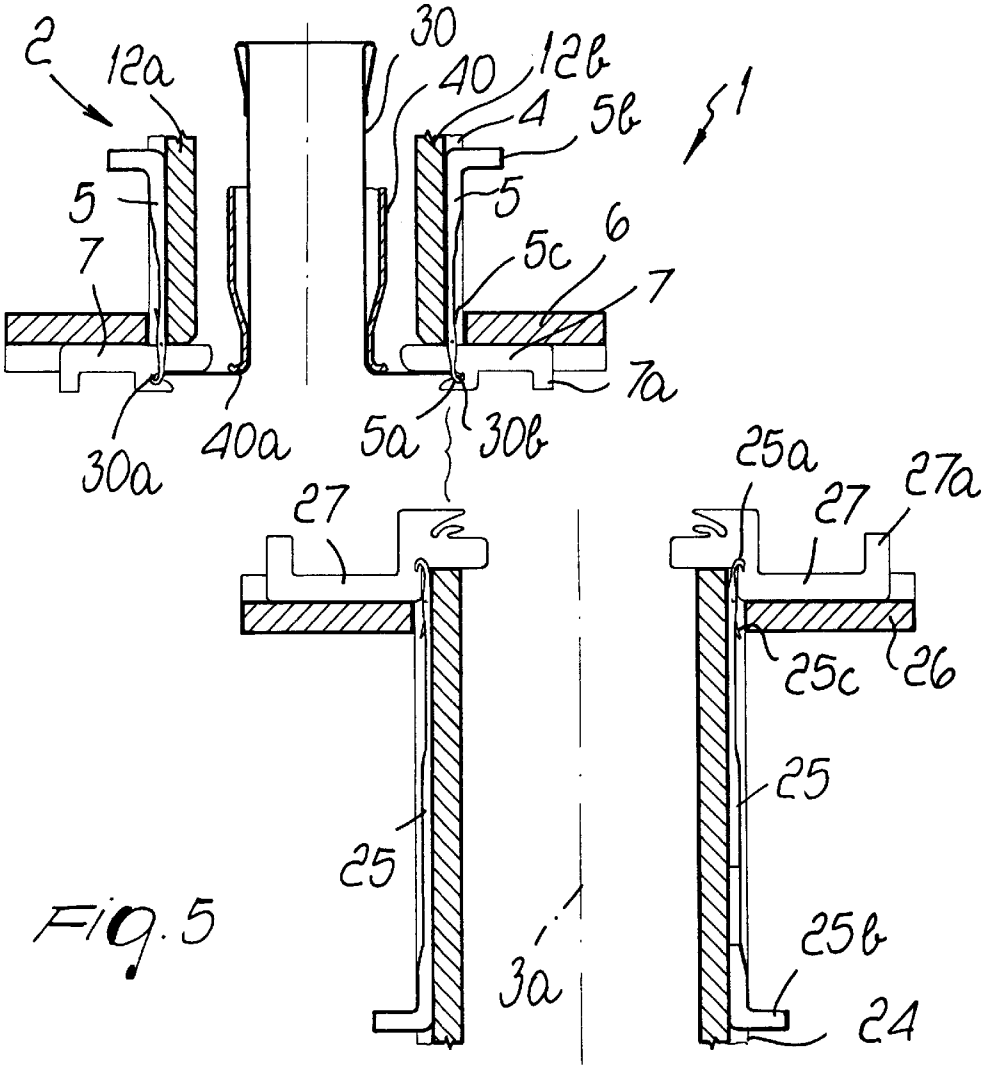

The auxiliary needle cylinder 2 is then moved away from the needle cylinder 3, as shown in FIG. 5.

Figure 6:
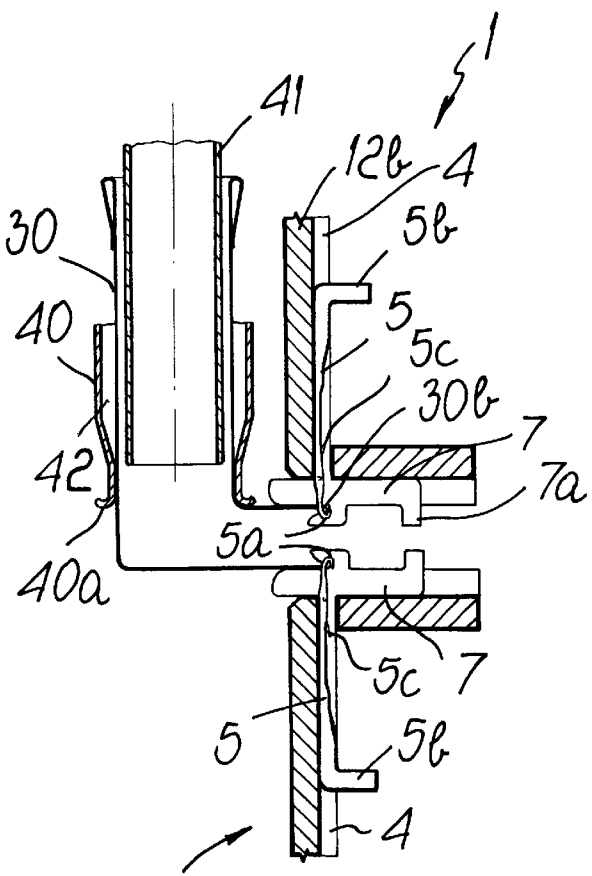

In a subsequent step, the first half 12*a* of the auxiliary needle cylinder 2 is turned over about the axis 13, so as to move the needles 5, which belong to the first half 12*a*, so that their tip 5*a* faces the tip 5*a* of the needles 5 that belong to the other half 12*b* of the needle cylinder 2, as shown in FIG. 6.

Figure 8:
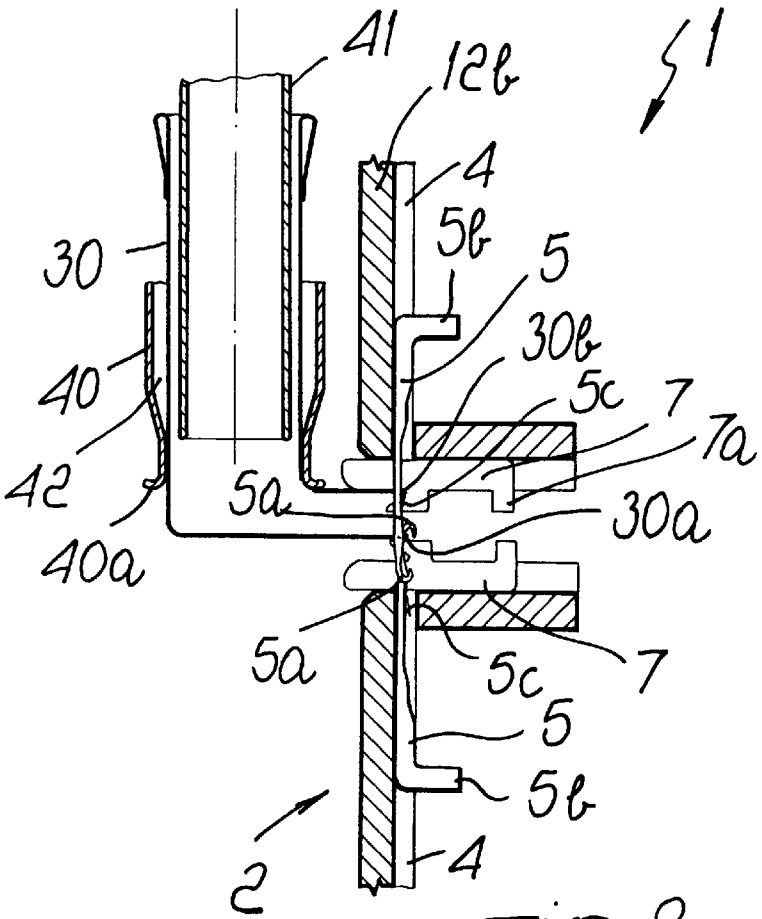
Figure 7:
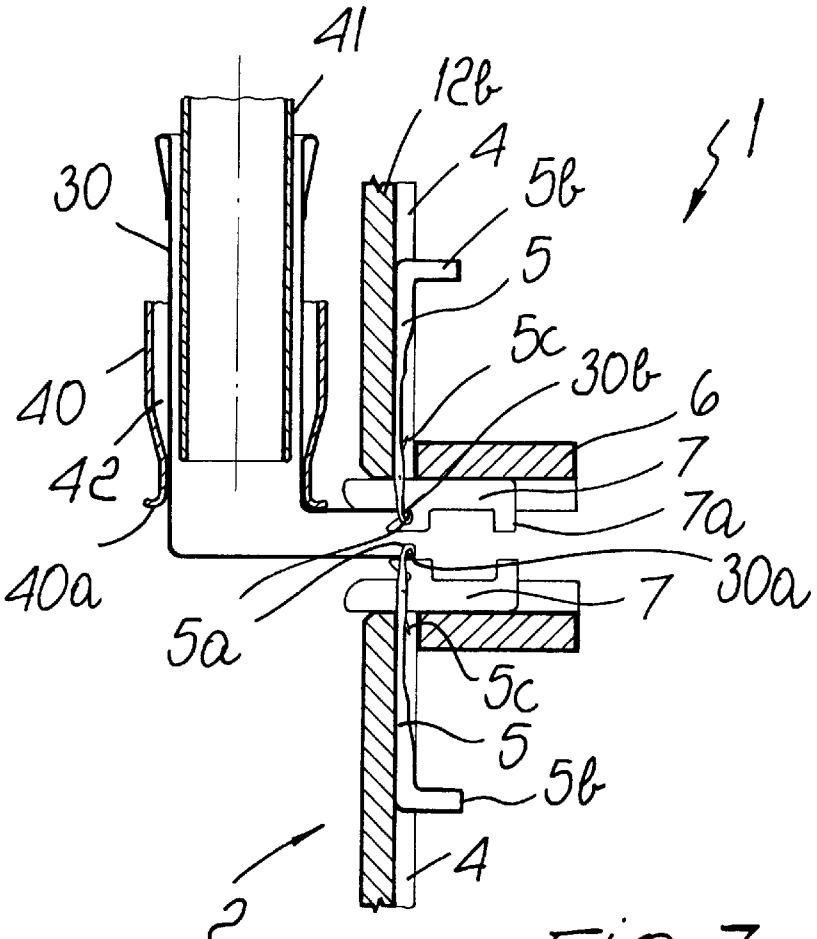

At this point, as shown in FIGS. 7 and 8, the needles 5 that belong to the first half 12*a* of the auxiliary needle cylinder 2 and the needles 5 that belong to the second half 12*b* of the auxiliary needle cylinder 2 are actuated toward each other so that the loops of knitting 30*a* of one half-row carried by the needles 5 of the first half 12*a* are transferred to the needles 5 of the second half 12*b* of the auxiliary needle cylinder 2 which carry the loops 30*b* of the other half-row.

It should be noted that the needles 5 that belong to the second half 12*b* of the auxiliary needle cylinder 2 engage the loops 30*a* released by the needles 5 that belong to the first half 12*a* of the auxiliary needle cylinder 2 preferably after the loops of knitting 30*b* previously received from the needles 25 of the needle cylinder 3 have passed, as a consequence of the downward movement of the corresponding needles 5, above the tongue 5cof said needles.

In practice, with this operation the loops 30*a* that belong to the half-row of knitting carried by the needles 5 that belong to the first half 12*a* of the auxiliary needle cylinder 2 are passed to the needles 5 that belong to the second half 12*b* of the auxiliary needle cylinder 2.

Figure 9:
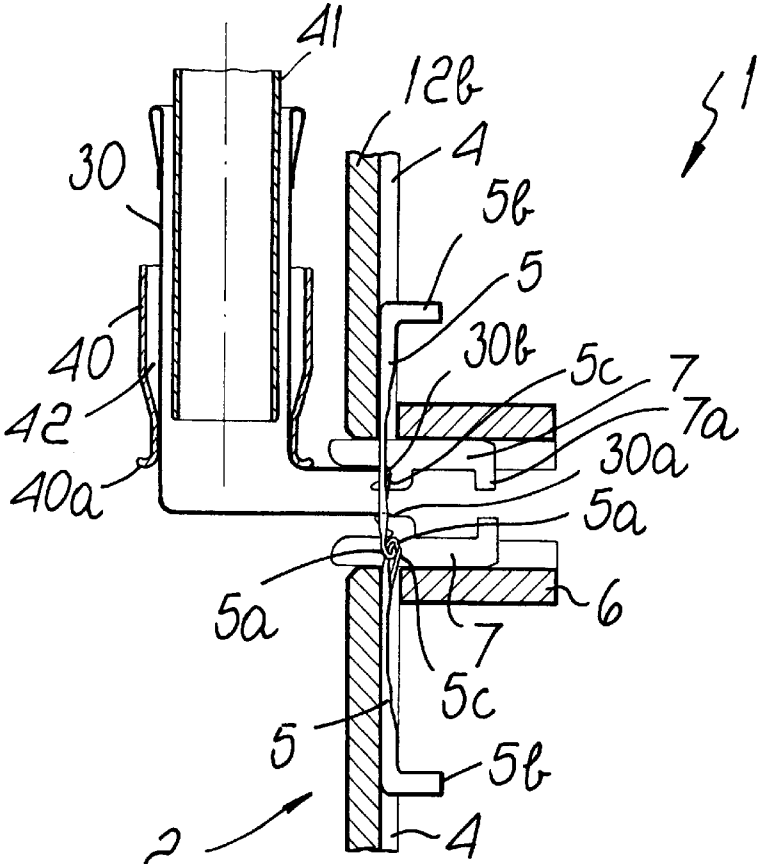

In a further step, shown in FIG. 9, the needles that belong to the first half 12*a* of the auxiliary needle cylinder 2 are raised until their tongue moves beyond the corresponding loop of knitting 30*a* and are then lowered so as to release said loop 30*a* of knitting, as shown in FIG. 9.

Figure 10:
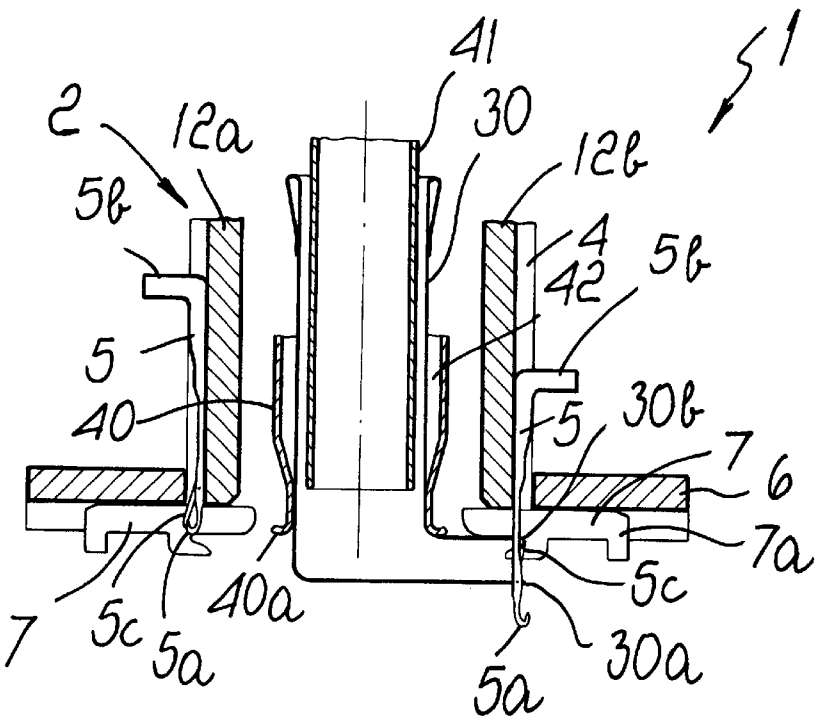

The first half 12*a* of the auxiliary needle cylinder 2 is then returned to the position in which it laterally faces the second half 12*b*, as shown in FIG. 10.

In the subsequent step, the needles 5 carried by the second half 12*b* of the auxiliary needle cylinder 2 are actuated so as to form at least one additional row of knitting 50, thereby closing the axial end of the item 30.

Figure 11:
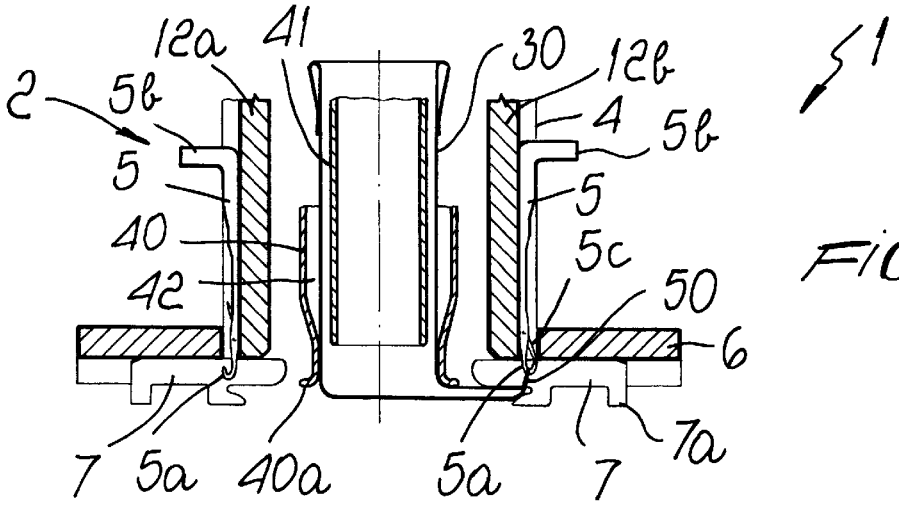
Figure 14:
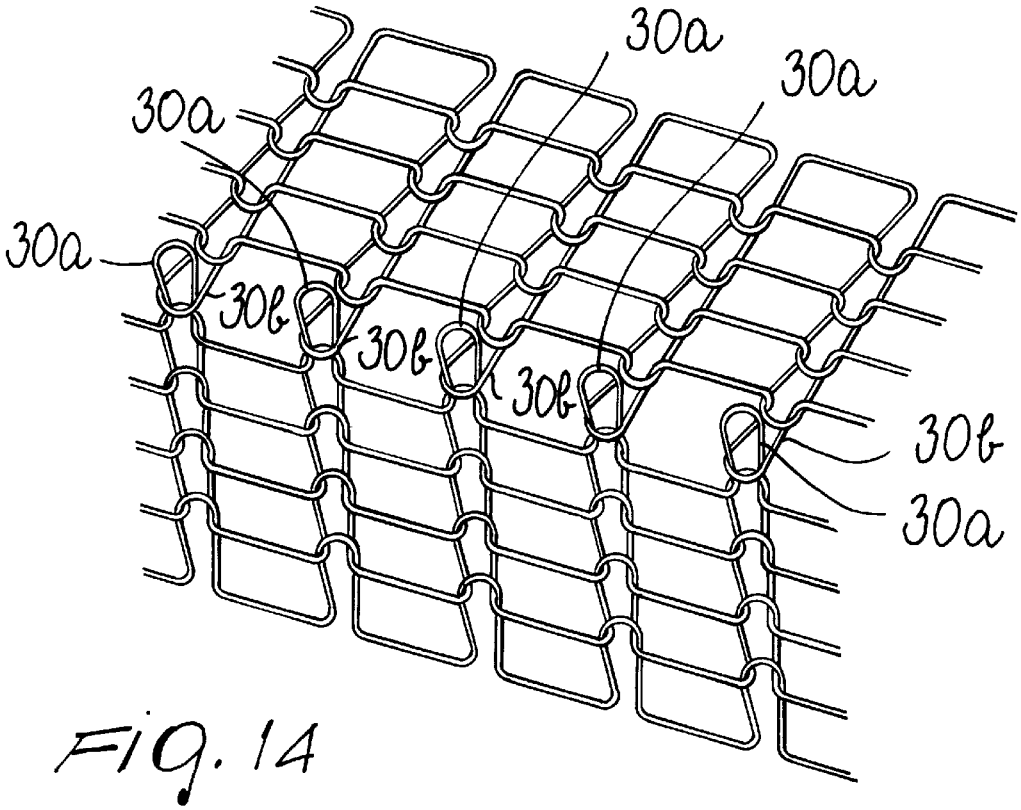
FIGS. 14 and 15 show schematically the closure of the item at one of its axial ends, which corresponds to the step of the method illustrated in Figure

Preferably, as shown in FIG. 11, the needles 5 of the second half 12*b* of the auxiliary needle cylinder 2 are actuated so as to transfer the loops of knitting 30*a* received from the needles that belong to the first half 12*a* of the auxiliary needle cylinder 2 inside the loops 30*b* that were already present on the needles 5 that belong to the second half 12*b* of the auxiliary needle cylinder 2 and had been transferred to them from the needles 25 of the needle cylinder 3. In this manner, the loops 30*a* of the half-row of knitting carried previously by the needles that belong to the first half 12*a* of the auxiliary needle cylinder 2 pass through the loops 30*b* of the other half-row which are arranged on the needles 5 of the first half 12*b* of the auxiliary needle cylinder, as shown in FIG. 14.

Figure 15:
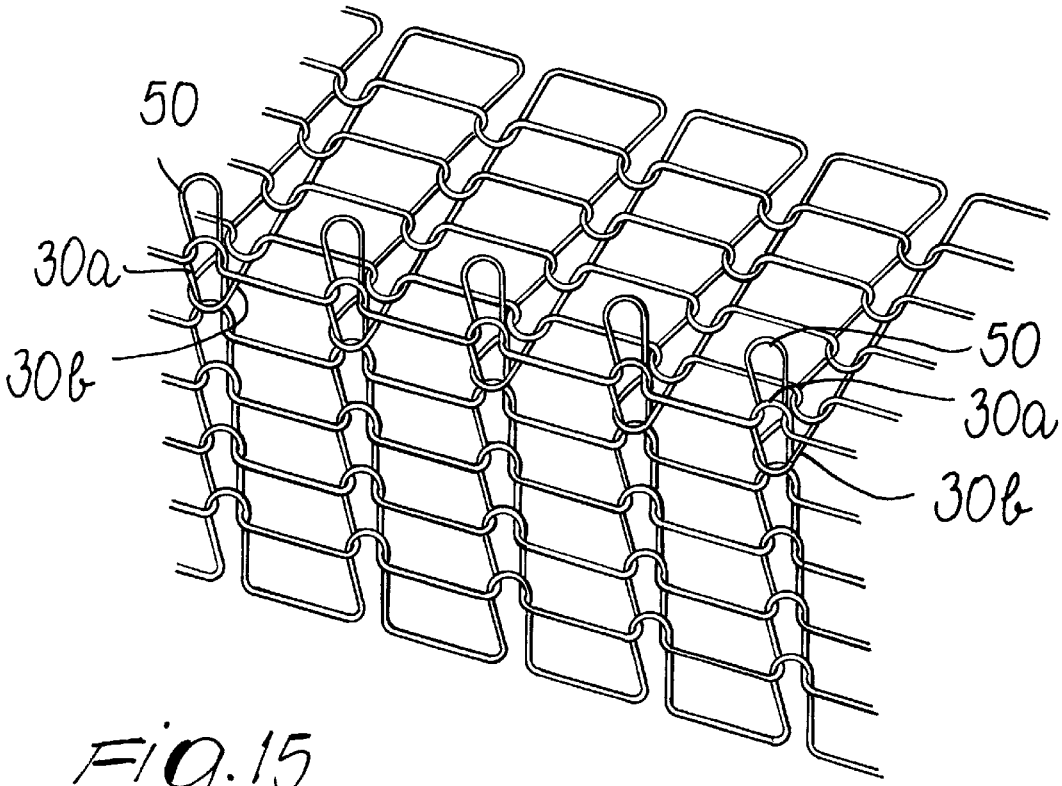

The needles of the second half 12*b* of the auxiliary needle cylinder 2 then form at least one additional row of knitting 50 which stabilizes the coupling of the loops 30*a* and 30*b* of the two half-rows, as shown in FIG. 15.

According to requirements, the needles of the second half 12*b* of the auxiliary needle cylinder 2 can form even more than one additional row.

During this step, the auxiliary needle cylinder 2 can be actuated with a rotary motion about its own axis 2*a* continuously or alternately, causing the needles 5 that belong to the second half 12*b* of the auxiliary needle cylinder 2 to pass in front of a feed at which the thread for forming the additional row or rows 50 is supplied.

It should be noted that due to the passage of the loops 30*a* that belong to one half-row inside the loops 30*b* that belong to the other half-row, one obtains a closure of the item at one of its axial ends which is comparable, in terms of compactness, with the closure that can be obtained by means of a conventional looping or sewing operation. Substantially, since the loops of the two half-rows are not simply joined together but are knitted in with each other, the resulting closure of the axial end of the item is tighter and fully satisfactory from an aesthetic point of view.

Moreover, due to the passage of the loops 30*a* of one half-row inside the loops 30*b* of the other half-row and by virtue of the formation of at least one additional row 50, any tensioning of the two flaps mutually joined at the closed axial end during use of the item does not apply stress directly to the additional row or rows of knitting 50 but tightens the first one of said additional rows by way of the loops 30*a* and 30*b* of the two half-rows which are knitted in together.

Figure 12:
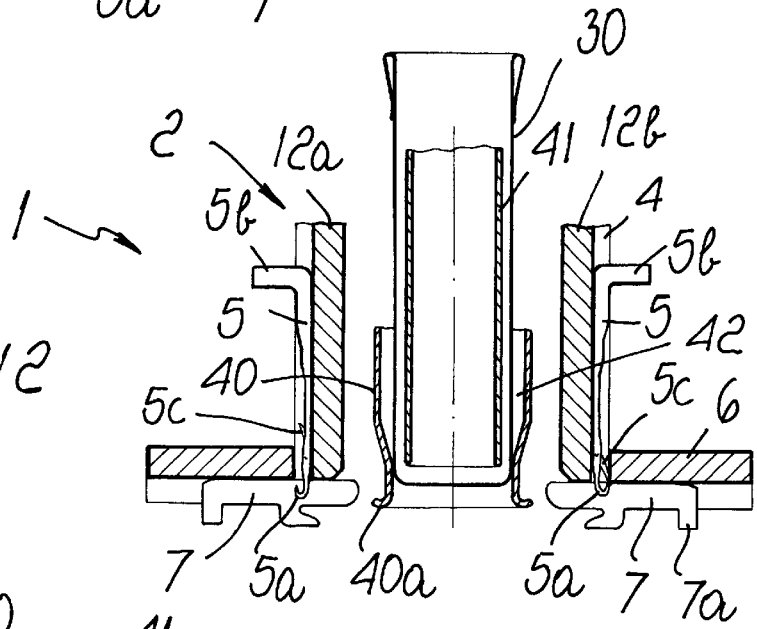

In a subsequent step, the loops of the additional row or rows 50 are released by the needles of the second half 12*b* of the auxiliary needle cylinder 2 and the item, as shown in FIG. 12, is drawn into the interspace 42, arranging itself with its closed axial end at the inlet of the second suction duct 41.

Figure 13:
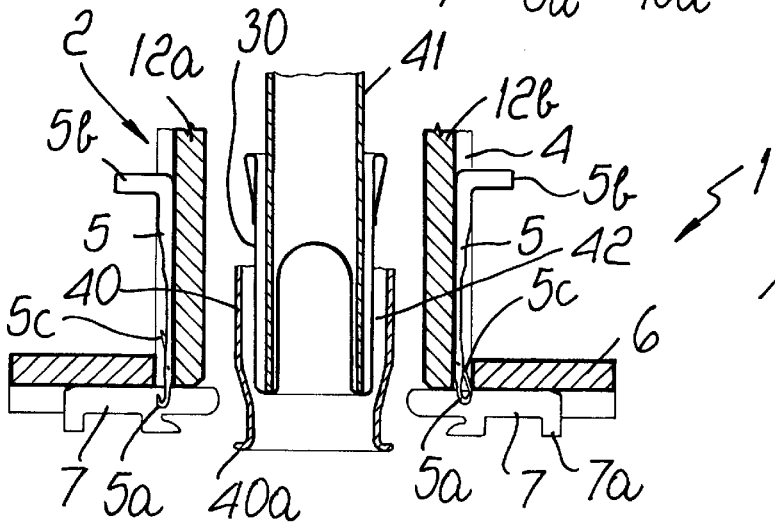

At this point suction inside the interspace 42 is interrupted and suction inside the second suction duct 41 is activated. In this manner, the item 30 is gradually drawn into the second suction duct 41 starting from its closed axial end and is thus reversed again and moved away from the auxiliary needle cylinder 2, as shown in FIG. 13.

In this manner, the item 30 is closed at one of its axial ends and is unloaded from the machine the "right way out".

It should be noted that according to requirements, instead of transferring a half-row of knitting from the needles 5 that belong to the first half 12*a* to the needles 5 that belong to the second half 12*b* of the auxiliary needle cylinder 2 it is possible to perform the opposite transfer, i.e., to transfer the loops 30*b* from the needles that belong to the second half 12*b* of the auxiliary needle cylinder 2 to the needles 5 that belong to the first half 12*a* of the needle cylinder 2. In this case, the item is closed by the needles that belong to the first half 12*a* of the auxiliary needle cylinder 2, which is kept below the second half 12*b* of the auxiliary needle cylinder 2 until the closure of the axial end of the item 30 is completed.

In practice it has been found that the method according to the invention fully achieves the intended aim and objects, since it allows to manufacture tubular items, particularly hosiery items, which are closed at one of their axial ends with a closure which is fully satisfactory as regards strength and as well as aesthetic appearance.

The method and the apparatus for performing it thus conceived are susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2000A000373 from which this application claims priority are incorporated herein by reference.

What is claimed is:

1. A method for manufacturing tubular knitted items closed at an axial end, comprising the steps of:

forming a tubular item on a circular knitting machine by way of needles of a needle cylinder thereof, starting from an axial end of the item which is opposite with respect to the axial end to be closed;

retaining on the needles of the needle cylinder a last formed row of knitting;

individually transferring loops of the last formed row of knitting from the needles of the needle cylinder to an auxiliary element provided with supporting means for individually supporting the loops, the supporting means of at least one half-row of said last row being adapted to receive two loops and to form knitting;

reversing the item;

transferring the loops of a first half-row from corresponding ones of it said supporting means to the supporting means of the loops of a second half-row;

forming with the supporting means supporting said half-rows at least one additional row of knitting to close the axial end of the item; and unloading the item from said supporting means.

2. The method of claim 1, wherein in the reversing step the item is reversed before transferring the loops of the last row of knitting formed on the needle cylinder to the auxiliary element.

3. The method of claim 1, wherein in the reversing step the item is reversed after transferring the loops of the last row of knitting formed on the needle cylinder to the auxiliary element.

4. The method of claim 1, wherein in the reversing step the item is reversed during the removal of the item from the auxiliary needle cylinder.

5. The method of claim 1, wherein, before forming said additional row of knitting, the loops of knitting of said first half-row transferred by the corresponding supporting means to the supporting means that support said second half-row are knitted in with the loops of said second half-row that are already present on said supporting means.

6. The method of claim 5, wherein at least one further row of knitting is formed after said additional row of knitting.

7. An apparatus for manufacturing tubular knitted items, closed at an axial end, for a circular knitting machine having at least one needle cylinder rotatable about an axis thereof and provided with needles, the apparatus comprising a circular auxiliary cylinder which is arrangeable above and coaxially with respect to the needle cylinder of the circular knitting machine and facing an end of the needle cylinder that corresponds to a needle work area of the circular knitting machine, said auxiliary element being provided with supporting means for individually receiving loops of a row of knitting that are formed and retained by the needles of the needle cylinder, the supporting means of at least one half-row of said row of knitting being actuatable in order to form knitting said auxiliary needle cylinder being provided with needles having each a tip which is directed downward, said needles being actuatable in a direction which is parallel to the axis of the needle cylinder in order to form knitting, receive, and transfer loops of knitting, said auxiliary needle cylinder comprising two halves which are mutually mated at a diametrical plane of the auxiliary needle cylinder, a first one of said two halves being rotatable with respect to the second half, about a diametrical axis, which is perpendicular to the axis of the needle cylinder, to make the tip of the needles of said first half face the needles of the other half of the auxiliary needle cylinder.

8. The apparatus of claim 7, further comprising reversing means for reversing the item.

9. The apparatus of claim 8, wherein said reversing means comprise a first item suction duct which is arranged inside said auxiliary needle cylinder and is connectable to suction means, said first suction duct having an inlet which is directed downward.

10. The apparatus of claim 9, wherein said reversing means comprise a second suction duct, which is arranged inside said first suction duct, is connectable to suction means, and has an inlet directed downwards in order to gradually draw thereinside an item stretched out between said first suction duct and said second suction duct starting from the closed axial end of the item in order to reverse said item.

* * * * *